US010344408B2

(12) United States Patent
Herold-Herrmann et al.

(10) Patent No.: US 10,344,408 B2
(45) Date of Patent: Jul. 9, 2019

(54) COMPRESSION KNIT FABRIC COMPONENT

(71) Applicant: medi GmbH & Co. KG, Bayreuth (DE)

(72) Inventors: Alexandra Herold-Herrmann, Marktleuthen (DE); Thomas Knauer, Weishausen (DE)

(73) Assignee: MEDI GMBH & CO. KG, Bayreuth (DE)

( * ) Notice: Subject to any disclaimer, the term of this patent is extended or adjusted under 35 U.S.C. 154(b) by 219 days.

(21) Appl. No.: 15/258,385

(22) Filed: Sep. 7, 2016

(65) Prior Publication Data

US 2017/0073861 A1 Mar. 16, 2017

(30) Foreign Application Priority Data

Sep. 10, 2015 (DE) ..... 10 2015 115 226

(51) Int. Cl.

*D04B 1/26* (2006.01)
*D04B 1/18* (2006.01)
*A41B 11/00* (2006.01)
*A41B 11/12* (2006.01)

(52) U.S. Cl.

CPC ..... *D04B 1/265* (2013.01); *A41B 11/00* (2013.01); *A41B 11/121* (2013.01); *D04B 1/18* (2013.01)

(58) Field of Classification Search

CPC ..... D04B 1/265; D04B 1/18; D04B 1/102; A41B 11/121

See application file for complete search history.

(56) References Cited

U.S. PATENT DOCUMENTS 1,702,608 A * 2/1929 Lawson et al. ..... D04B 9/32 66/108 R
2,375,474 A * 5/1945 Holmes ..... D04B 1/26 66/180
2,648,963 A * 8/1953 Holmes ..... D04B 9/10 66/135

(Continued)

FOREIGN PATENT DOCUMENTS

DE 202004003417 U1 7/2005
DE 202005015371 U1 12/2005

(Continued)

OTHER PUBLICATIONS

Overview of European Search Report for corresponding European Application No. 16 185 616.6 dated Feb. 9, 2017 (1 page).

*Primary Examiner* — Danny Worrell
(74) *Attorney, Agent, or Firm* — Lucas & Mercanti, LLP

(57) ABSTRACT

A compression knit fabric, in particular a flat-knit fabric, composed of at least one knitted yarn and an incorporated elastic weft yarn, with a first knit fabric section having a compressive first base weave, to which is attached a second knit fabric section having a second weave different from the base weave which imparts to the second knit fabric section greater elasticity in the longitudinal and/or transverse direction of the knit fabric section than in the first knit fabric section, to which is attached a third knit fabric section having a third weave different from the first base weave and second base weave which imparts to the third knit fabric section greater elasticity in the longitudinal and/or transverse direction of the knit fabric section than in the second knit fabric section.

34 Claims, 6 Drawing Sheets

(56) References Cited

U.S. PATENT DOCUMENTS

| | | | | |
|---|---|---|---|---|
| 8,402,795 | B2 | 3/2013 | Failenschmid | |
| 2006/0081013 | A1 * | 4/2006 | Gross | D04B 1/14 66/64 |
| 2014/0316312 | A1 | 10/2014 | Atmanspacher | |

FOREIGN PATENT DOCUMENTS

| | | | | |
|---|---|---|---|---|
| DE | 102011012767 | A1 | 3/2012 | |
| DE | 102012004150 | A1 | 8/2013 | |
| DE | 102013103914 | B3 | 3/2014 | |
| EP | 1561846 | A1 | 8/2005 | |
| EP | 2436276 | A1 | 4/2012 | |
| FR | 2781816 | A1 | 2/2000 | |
| FR | 2781816 | B1 * | 9/2000 | D04B 1/18 |

* cited by examiner

COMPRESSION KNIT FABRIC COMPONENT

CROSS-REFERENCE TO RELATED APPLICATIONS

The present application claims priority of DE 10 2015 115 226.6, filed Sep. 10, 2015, the priority of this application is hereby claimed and this application is incorporated herein by reference.

BACKGROUND OF THE INVENTION

The invention concerns a compression knit fabric component, in particular a flat-knit fabric component, composed of at least one knitted yarn and an incorporated elastic weft yarn.

Such compression knit fabric components are in known in different embodiments. The most prominent example is a stocking or a sock, but longer leggings which encircle the lower leg and optionally the thigh as well but do not have a foot section, or arm pieces that are pulled over the upper or lower arm, as well as knitted body fabrics, are also known. These are all characterized by the compressive action of the knit fabric component, which means that the knit fabric component exerts a defined pressure on the body part in question or the underlying tissue, for example in order to provide lymphological treatment of said body part or tissue.

The wearable compression knit fabric component often comprises a flat-knit fabric component composed of at least one knitted yarn and an incorporated elastic weft yarn, after which the flat-knit fabric component is stitched or glued at the side in order to provide a corresponding tubular geometry. In some cases, such a knit fabric component is also produced by circular knitting as a 'seamless' knit fabric on a flat knitting machine. Such a knit fabric component can be knitted from only one knitted yarn and an incorporated weft yarn, but the method is also known of producing the knit fabric component using two knitted yarns, in which both may be inelastic, both may be elastic, or one may be elastic and the other inelastic, and a weft yarn incorporated into the stitches thus formed.

In some cases, the body part of the wearer which is covered by the compression knit fabric component and is therefore subjected to pressure is an area that is sensitive to pressure because of an existing inflammation, deformity, etc., so that pressure applied to this area by the compression knit fabric component is perceived as uncomfortable or painful. However, as the body area in question requires treatment with the compression knit fabric component, e.g. due to lymphological or orthopedic considerations, the wearer must tolerate this discomfort. An example of such a pressure-sensitive area is hallux valgus, a deformity of the base joint of the big toe, which is characterized by deviation of the big toe and protrusion of the ball of the big toe on the inner side of the foot. Painful inflammations frequently occur in the area of the base joint of the big toe. Other examples are inflammations in the area of the knee or elbow joint, or local areas with skin irritations and the like.

SUMMARY OF THE INVENTION

The problem to be solved by the invention is that of providing a compression knit fabric component that is an improvement over the above and provides the wearer with greater comfort.

In order to solve this problem, the invention provides a compression knit fabric component composed of at least one knitted yarn and an incorporated elastic weft yarn, with a first knit fabric section having a compressive first base weave, to which is attached a second knit fabric section having a second weave different from the base weave which imparts to the second knit fabric section greater elasticity in the longitudinal and/or transverse direction of the knit fabric section than in the first knit fabric section, to which is attached a third knit fabric section having a third weave different from the first base weave and second base weave which imparts to the third knit fabric section greater elasticity in the longitudinal and/or transverse direction of the knit fabric section than in the second knit fabric section.

The knit fabric component according to the invention is characterized by at least three defined knit fabric sections or zones, two of which, specifically the second and in particular the third knit fabric section, form a defined area of reduced compression and thus allow targeted local relief of the pressure on the area of the body in question. For this purpose, three different knit fabric sections are knitted with three different weaves. The actual base knit fabric, the first knit fabric section, forms the largest, essential part of the knit fabric. It defines the basic compressive properties of the knit fabric component. It is knitted with a compressive first base weave such as those commonly used or prescribed for known knit fabrics, in particular flat-knit fabrics.

To this first knit fabric section is connected a second knit fabric section which is knitted with a second weave that is different from the first base weave. This second weave is selected in such a way that the second knit fabric section shows somewhat greater elasticity in the longitudinal and/or transverse direction of the second knit fabric section than that of the first knit fabric section in the longitudinal and/or transverse direction. Naturally, a weave is preferably selected which provides greater elasticity in both the longitudinal and transverse directions.

A third knit fabric section, which is in turn knitted with a weave different from the first base weave and the second weave, is then attached to this second knit fabric section. The weave selected here provides the third knit fabric section in turn with greater elasticity in the longitudinal and/or transverse direction of the knit fabric section than that of the second knit fabric section, preferably in the longitudinal and transverse directions. Three defined areas or zones are therefore formed which have different elasticities in the longitudinal and/or transverse direction, preferably in the longitudinal and transverse directions, specifically the first, strongly compressive knit fabric section, followed by the second, somewhat more elastic knit fabric section, which is followed in turn by the third, comparatively even more elastic knit fabric section.

As described above, the first knit fabric section forms the base knit fabric, i.e. by far the largest part of the knit fabric. The second knit fabric section and the third knit fabric section are knitted in such a way that they form a locally defined relief zone within the first knit fabric section, i.e. the base knit fabric. This means that the basic compression of the knit fabric component is reduced only locally in this area or this zone. However, because the second knit fabric section, which is somewhat more elastic than the first but somewhat less elastic than the third, is knitted between the first and the third knit fabric section, a soft transition of elasticity from the first to the third knit fabric section is achieved, which means that there is no abrupt increase in elasticity. In this way, the pressure decreases with a sufficiently soft transition from a relatively high value in the first knit fabric section to a relatively low value in the third knit fabric section. In principle, it would also be possible to add to the third knit fabric section a fourth knit fabric section that is even more elastic because of having a different weave.

The invention therefore concerns a compression knit fabric, in particular flat-knit fabric, composed of at least one knitted yarn and an incorporated elastic weft yarn, with a first knit fabric section composed of a plurality of stitch rows having a compressive first base weave, characterized in that a local relief zone is formed, in which, in a plurality of stitch rows between two areas of the first knit fabric section, a second knit fabric section attached to the first knit fabric section having a second weave different from the base weave which imparts to the second knit fabric section greater elasticity in the longitudinal and/or transverse direction of the knit fabric section than in the first knit fabric section, and a third knit fabric section attached to the second knit fabric section having a third weave different from the first base weave and second base weave which imparts to the third knit fabric section greater elasticity in the longitudinal and/or transverse direction of the knit fabric section than in the second knit fabric section are knitted.

For the wearer of the knit fabric component, integration of this defined relief zone by means of knitting technology provides a significant improvement in wear comfort and a reduction in pressure on a pressure-sensitive area, which is sometimes painful. For example, if the knit fabric component or flat-knit fabric component is a compression stocking or a compression sock, and if the wearer suffers from hallux valgus, this relief zone in the compressive stocking or compressive sock according to the invention can be configured by means of knitting technology in the precise area that covers the base joint of the big toe or the balls of the big toes, so that the pressure on this sensitive area can be reduced by means of the relief area according to the invention.

According to a first variant of the invention, all of the knit fabric sections are knitted with an RR knitted yarn, an RL knitted yarn which is more elastic as a rule, and the weft yarn. An RR knitted yarn is a right-right knitted yarn which is relatively inelastic. An RL knitted yarn is a right/left knitted yarn which in contrast is usually more elastic. The weft yarn itself is elastic. All of these yarns may be optionally entwined. The use of two knitted yarns makes it possible to form the three different knitted weaves using the corresponding yarn.

In this case, it is preferred if the first base weave comprises a half-tube weave of the RR knitted yarn, which is knitted with an RR weave, the RL knitted yarn, which is knitted with an RL weave, and the incorporated weft yarn. The two stitch-forming knitted yarns are knitted with different weaves. The RR knitted yarn is knitted with a right/right weave, while the RL knitted yarn is knitted with a right/left weave on the front or rear needle bed of the flat knitting machine. The weft yarn is incorporated into the knitted stitches, or under or in front of them. This so-called half-tube weave constitutes the first base weave, i.e. the compressive base weave.

The second base weave is preferably a tuck weave, which means that the RR knitted yarn is tuck-knitted and the RL knitted yarn is knitted with an RR weave. As the RR knitted yarn is tuck-knitted, the second knit fabric section shows greater elasticity than the compressive first knit fabric section, in this case preferably in the longitudinal and transverse directions of the knit fabric section. This means that the second weave, i.e. the tuck weave, is more elastic than the compressive base weave. This is primarily attributable to the design of the tuck stitches on the side of the RR knitted yarn, which is not configured with the tuck stitches so as to form a mesh. An inverted knitting method, in which the RL knitted yarn is tuck-knitted and the RR knitted yarn is knitted with an RL weave, would also be conceivable.

According to the invention, in order to form the third weave, the RR knitted yarn is in turn knitted with an RR weave, while the RL knitted yarn is again knitted with an RR weave. However, at least some of the stitches knitted with the RR knitted yarn are transferred, i.e. transferred from the front to the rear needle bed or vice versa. Because the stitches knitted with the RR knitted yarn are partially transferred, and because the RL knitted yarn is knitted with an RR weave on both needle beds of the flat knitting machine, the RL knitted yarn, which is ordinarily more elastic than the RR knitted yarn, forms corresponding tuck stitches, as it is partially knitted on the empty needles resulting from the transfer of the RR stitches. Thus a right/right-knitted weave is knitted which becomes even more elastic because of the stitch transfer to the opposite needle bed. As a result of transferring the stitches, small, open, stitch-free areas form in the third knit fabric section within the individual stitch rows, i.e. extremely small 'holes,' which means that the third knit fabric section is relatively 'open'. Alternatively, simultaneous transfer of the stitches is also conceivable, and in this case, transfer takes place in alternating fashion, with one stitch being transferred from the front needle bed to the rear, and one stitch being transferred from the rear needle bed to the front, etc. In the case of a 'seamless' knit fabric, the stitches would be transferred to adjacent stitches. In both cases, this transfer causes an increase in elasticity.

Preferably, every second, third, or fourth stitch knitted with the RR knitted yarn is transferred, with the transferred stitches of one stitch row knitted with the RR knitted yarn optionally being staggered with respect to the transferred stitches of the previous stitch row knitted with the RR knitted yarn. In this case, therefore, the 'holes' in question are configured staggered in a transverse direction, so they are uniformly distributed. However, this staggering is not required, and in this case the 'holes' would then be in a straight row. In order to achieve the greatest possible elasticity in the third knit fabric section, every second RR stitch is preferably transferred.

Alternatively, in order to use two knitted yarns to form all of the knit fabric sections, the knit fabric sections can also conceivably be kitted with only one RR knitted yarn and the weft yarn. In this case, therefore, only one knitted yarn would be used.

In the above case, the first base weave is preferably an RR weave knitted from the RR knitted yarn into which stitches of the weft yarn are incorporated.

In order to increase the elasticity of the fabric in the second knit fabric section, it is also preferable in this case to provide a tuck weave as second weave, which means that the RR knitted yarn is tuck-knitted. By means of this tuck weave, as a result of the tuck stitches produced in the RR knitted yarn, the second knit fabric section is again made somewhat more elastic in the longitudinal and transverse directions, so that a reduction in pressure can be initiated over this second knit fabric section.

The third knit fabric section can finally be knitted with an RR weave, with at least some of the stitches knitted with the RR knitted yarn being transferred from one needle bed to the other needle bed. This means that in this case, right/right weave knitting is carried out with stitch transfer. In turn, this stitch transfer causes small 'holes' to be made in the knit fabric in the respective stitch rows in the area of the transferred stitches, which means that the third knit fabric section is significantly more 'open' with respect to the mesh structure than the second and the first knit fabric section. This results in even greater elasticity in the third knit fabric section in the longitudinal and transverse directions compared to the second knit fabric section. Here as well, transfer to an adjacent stitch is possible in the case of a 'seamless' knit fabric.

Here as well, every second, third, or fourth stitch knitted with the RR knitted yarn can be transferred, depending on the desired size of the third knit fabric section and its desired elasticity. In this case, the transferred stitches of one stitch row knitted with the RR knitted yarn may be staggered with respect to the transferred stitches of the previous stitch row knitted with the RR knitted yarn, resulting in staggering of the 'holes' from one stitch row to the next. However, this is not absolutely necessary.

On the whole, therefore, the configuration of the three knit fabric sections with only one RR knitted yarn, which (compared to an RL knitted yarn) is relatively inelastic, on selection of the corresponding different weaves and optionally yarn types, allows the configuration of different elastic knitted sections and the production of a pressure relief zone having a soft transition between the more elastic third knit fabric section and the much less elastic and therefore highly compressive first knit fabric section.

Finally, the geometry of the pressure relief zone composed of the second and third knit fabric sections may be selected as desired. As a rule, the first knit fabric section may partially or completely surround the second knit fabric section and/or the second knit fabric section may partially or completely surround the third knit fabric section. For example, if the pressure relief zone is configured in an area of the flat-knit fabric located more toward the inside, the first knit fabric section will partially or completely surround the second knit fabric section, and the second knit fabric section will partially or completely surround the third knit fabric section. The second and third knit fabric section may be knitted in ring, circular, elliptical, or rectangular shapes, and the geometry in this case may vary widely. For example, if the flat-knit fabric is a stocking or a sock, and if the purpose of the relief zone is to take pressure off the hallux valgus, it is conceivable that the first knit fabric section only partially surrounds the second knit fabric section and the second knit fabric section only partially surrounds the third knit fabric section, and all of the knit fabric sections are connected to a knit fabric covering the toes, i.e. a fourth knit fabric section, which could then have no compressive properties, for example. However, such a fourth knit fabric section, which is connected at least to the first knit fabric section, does not necessarily have to surround the second and third knit fabric sections, and is preferably knitted without weft yarn, as it does not necessarily have to have compressive properties. Of course, all three knit fabric sections can be attached to the fourth knit fabric section, in which case the first knit fabric section may only partially surround the second, and the second knit fabric section may only partially surround the third knit fabric section. Any desired patterns or geometries can therefore be produced, but their common characteristic is that at least locally, the first knit fabric section is connected to the second knit fabric section, and the latter is connected to the third knit fabric section. As described above, this process may also be exclusively local, i.e. the third knit fabric section outside this 'zone' can also be directly connected to the first knit fabric section.

For example, the flat-knit fabric itself may be a stocking or a sock, but also a leg stocking (without a foot component), an arm stocking, a body component, or a bandage.

In addition to the flat-knit fabric itself, the invention also concerns a method for producing such a flat-knit fabric using a flat knitting machine having a front and rear needle bed. In this method according to the invention, a first knit fabric section is knitted with a compressive first base weave to which is knitted a second knit fabric section having a second weave different from the base weave which imparts to the second knit fabric section greater elasticity in the longitudinal and/or transverse direction of the knit fabric section than in the first knit fabric section, to which in turn is knitted a third knit fabric section having a third weave different from the first base weave and second base weave which imparts to the third knit fabric section greater elasticity in the longitudinal and/or transverse direction of the knit fabric section than in the second knit fabric section.

According to a first variant of the invention, all of the knit fabric sections can be knitted with an RR knitted yarn, an RL knitted yarn, and the weft yarn. Preferably, a half-tube weave composed of an RR knitted yarn which is knitted with an RR weave, an RL knitted yarn which is knitted in an RL weave, and the incorporated weft yarn are knitted together to form a first base weave. The compressive base knit fabric is formed in this manner. In the second weave, i.e. in order to form the second knit fabric section, the RR knitted yarn is preferably tuck-knitted and the RL knitted yarn knitted with an RR weave. A tuck weave is therefore produced on the side of the RR knitted yarn, which makes this second weave more elastic than the first base weave. As explained above with respect to the knit fabric component, inverted knitting, in which the RL knitted yarn is tuck-knitted and the RR knitted yarn is knitted with an RL weave, is also possible. Finally, in the third weave, the RR knitted yarn is knitted with an RR weave and the RL knitted yarn is knitted with an RR weave, i.e. both are knitted with the same weave, but at least some of the stitches knitted with the RR knitted yarn are transferred from the front needle bed to the rear needle bed. As a result of this transfer, i.e. the transfer of the stitches, small individual 'holes' form in the mesh structure, as described above, and an open mesh structure is therefore formed. The fact that tuck stitches are formed in the RL yarn when it is knitted with an RR weave because it is then transferred to empty needles, from which the RR stitches of the RR knitted yarn were previously transferred, causes a further increase in elasticity, which means that the third knit fabric section becomes even softer. In this case, every second, or if needed also every third or fourth stitch knitted with the RR knitted yarn can be transferred, in which case the transferred stitches of one stitch row knitted with the RR knitted yarn may but do not have to be staggered with respect to the transferred stitches of the previous stitch row knitted with the RR knitted yarn. Alternatively, simultaneous transfer of the stitches is also conceivable, and in this case, the transfer takes place in alternating fashion, with one stitch being transferred from the front needle bed to the rear and one stitch being transferred from the rear needle bed to the front, etc. In the case of a 'seamless' knit fabric, the stitches would be transferred to adjacent stitches. In both cases, the transfer results in increased elasticity.

Alternatively, in use of two knitted yarns, it is also conceivable for all of the knit fabric sections to be knitted with an RR knitted yarn and the weft yarn, which means that in this case, the stitches are formed by only one knitted yarn. Here, in knitting a first base weave, one can use an RR weave knitted from the RR knitted yarn, i.e. RR stitches, into which the weft yarn is incorporated. The second knit fabric section is knitted with a second weave, a tuck weave, which means that the RR knitted yarn is tuck-knitted, with the tuck stitches increasing the elasticity within the knit fabric. In the third weave, the RR knitted yarn is finally knitted with an RR weave, with at least some of the stitches knitted with the RR yarn being transferred from one to the other needle bed. Here as well, corresponding tuck stitches are formed, after which the RR yarn is knitted on both needle beds. At the same time, in this case as well, the transfer leads to the formation of 'holes' in the mesh structure, i.e. to a certain openness of the third knit fabric section. In the case of a 'seamless' knit fabric, transfer to an adjacent stitch is possible here as well. Moreover, every second, or if needed also every third or fourth RR stitch may be transferred, with the transferred stitches optionally being staggered with respect to the transferred stitches of the previous stitch row, but this is not required.

With respect to the geometry to be formed by the first, second, and third knit fabric section and/or the arrangement of the second and third knit fabric sections on or in the first knit fabric section, there is again a great deal of freedom. For example, the first knit fabric section can completely surround the second knit fabric section and/or the second knit fabric section can completely surround the third knit fabric section, which means that the relief zone lies almost completely within the first knit fabric section and a surrounding second fabric section that allows a soft pressure transition is provided. Alternatively, it would also be conceivable for the respective knit fabric sections to only partially surround one another.

The knit fabric component is preferably knitted as a stocking, sock, leg stocking without a foot section, arm stocking, body component, or bandage. In knitting of a stocking or sock in particular, a fourth knit fabric section, preferably without the weft yarn, can be knitted, to which at least the first knit fabric section is connected, with this fourth knit fabric section without weft yarn having no compressive properties. If this fourth knit fabric section is a toe section, and if the purpose is to relieve pressure in the case of hallux valgus, all three knit fabric sections can be attached to the fourth knit fabric section, with the first knitted section only partially including the second and the second knitted section only partially including the third.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
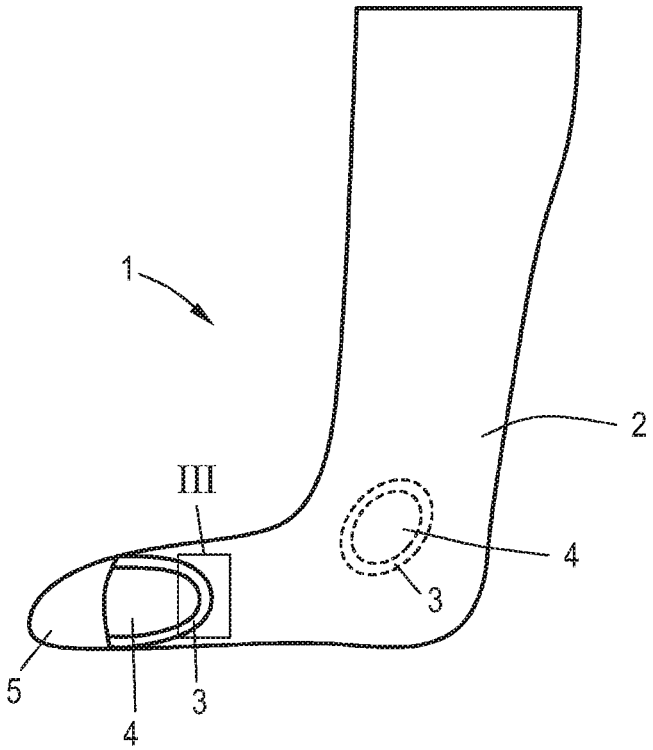
FIG. 1 is a schematic diagram of a compression knit fabric component according to the invention in the form of a stocking.

FIG. 1 shows a compression knit fabric component according to the invention as a flat-knit fabric component 1 in the form of a stocking. The flat-knit fabric component 1 consists in the example shown of four knit fabric sections, and specifically has a first knit fabric section 2 knitted with a compressive first base weave. This first knit fabric section forms the compressive base knit fabric. A second knit fabric section 3, which is knitted with a second weave differing from the first base weave, is knitted to the first knit fabric section 2. This second weave is selected so as to provide the second knit fabric section with greater elasticity in the longitudinal and/or transverse direction, preferably in both directions, than that of the first knit fabric section 2. Finally, a third knit fabric section 4 with a third weave differing from the first two weaves is knitted to the second knit fabric section 3 and is selected so as to again provide the third knit fabric section 4 with greater elasticity in the longitudinal and/or transverse direction, preferably in both directions, than that of the second knit fabric section 3. There is therefore an increasing elasticity gradient from the first knit fabric section 2 over the second knit fabric section 3 to the third knit fabric section 4, so that an area of greater elasticity and therefore lower compressive pressure compared to the first knit fabric section 2 is formed over the knit fabric sections 3 and 4.

All of the knit fabric sections 2, 3, and 4 may be knitted with only one knitted yarn and one elastic weft yarn incorporated into the knitted stitches. Alternatively, two knitted yarns into whose stitches the elastic weft yarn is incorporated may also be used. Of the two knitted yarns used, one knitted yarn may be largely inelastic and the other elastic, both knitted yarns may be inelastic, or both knitted yarns may be elastic. Preferably, one largely inelastic and one elastic knitted yarn are used. The yarns used may be optionally entwined.

In the embodiment of a stocking shown, a fourth knit fabric section 5 is also provided which forms the toe section. This section is knitted only with the knitted yarn(s), and not with the weft yarn. In the example shown, this fourth knit fabric section 5 is connected to all three knit fabric sections 2, 3, and 4. This means that in this embodiment, the first knit fabric section 2 only partially surrounds the second knit fabric section 3, and the second knit fabric section 3 only partially surrounds the third knit fabric section 4. In this case, the relief zone is therefore formed over the second and third knit fabric sections 3, 4 in the area of the hallux valgus, in order not to excessively compress said hallux valgus area. However, if such a relief zone is provided, for example, in the area of the ankle joint, indicated by the dotted lines in FIG. 1, the second and third knit fabric sections 3, 4 will be knitted in the shape of a circle, an ellipse, etc., but in this case the respective knit fabric sections completely enclose one another. The second knit fabric section 3, which is only intended to act as a soft elastic transition, may be relatively narrow, i.e. only a few stitches wide, compared to the third knit fabric section 4, which is the most elastic section, provides the essential pressure relief, and is therefore much larger. This combination is only an example, and other variants or geometries are also possible.

Figure 2:
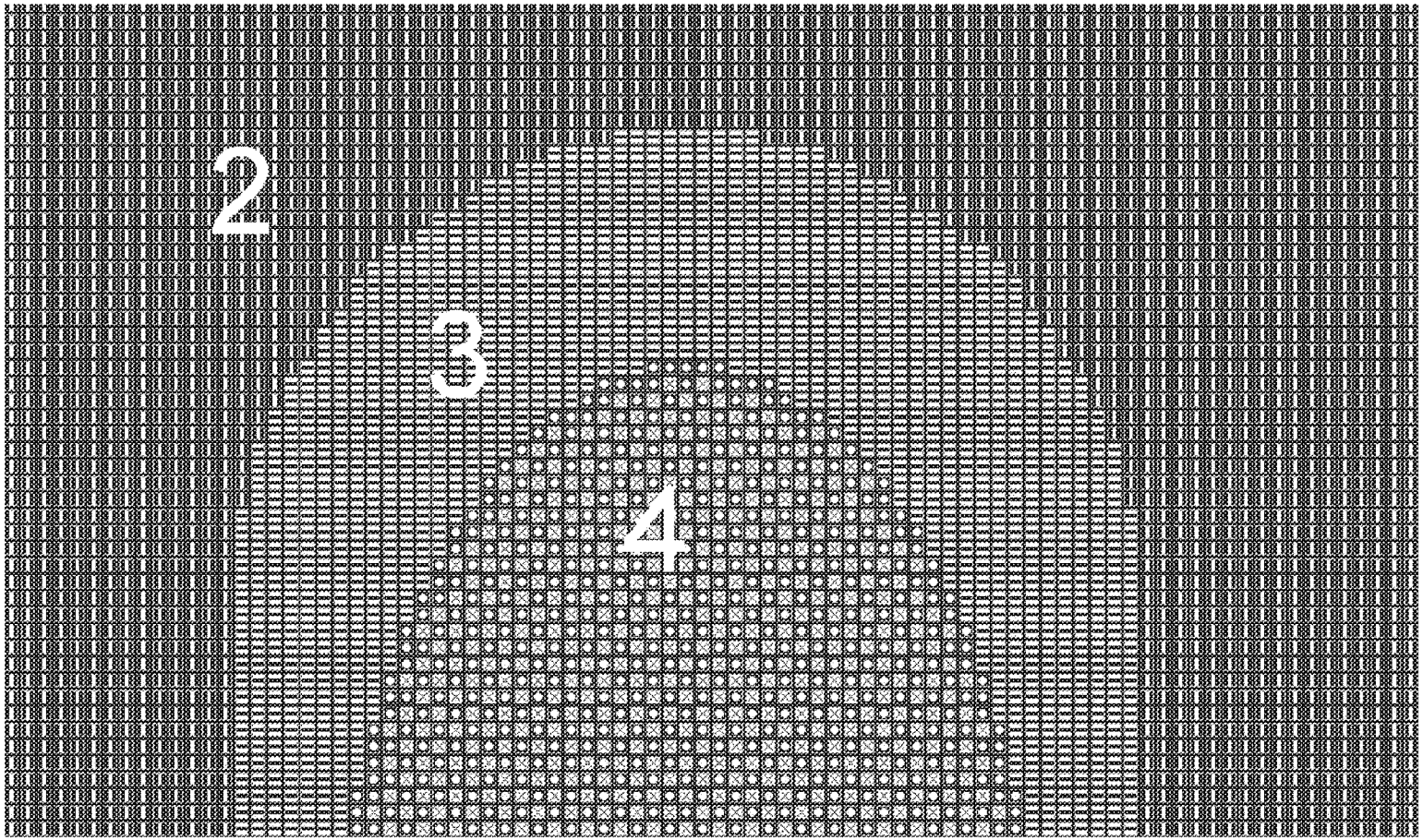
FIG. 2 is an enlarged partial sectional view of the first, second, and third knit fabric section.

FIG. 2 shows an enlarged schematic diagram of a sectional view III of FIG. 1 showing the first knit fabric section 2, the second knit fabric section 3, and the third knit fabric section 4, each in a partial view. The different weaves and stitches are indicated by the different symbols in the individual fields of the respective knit fabric sections 2, 3, and 4. In the embodiment shown, the first knit fabric section 2 is knitted with a compressive base weave, for example a half-tube weave or a pure right/right weave. This is indicated by the longitudinal symbols. In contrast, the second knit fabric section 3 is knitted with a softer, more elastic tuck weave, and it forms a kind of transitional zone between the first knit fabric section 2 and the third knit fabric section 4. The tuck weave is indicated by the transverse symbols. The third knit fabric section 4 is knitted for example with an elastic right/right weave having partially transferred stitches, which provides even greater elasticity of the knit fabric. In the following, two embodiments are described in greater detail which show how the individual knit fabric sections could be produced using differing yarns. The right/right weave is indicated by the circular symbols, and the transferred stitches by the cross symbols.

Figure 3:
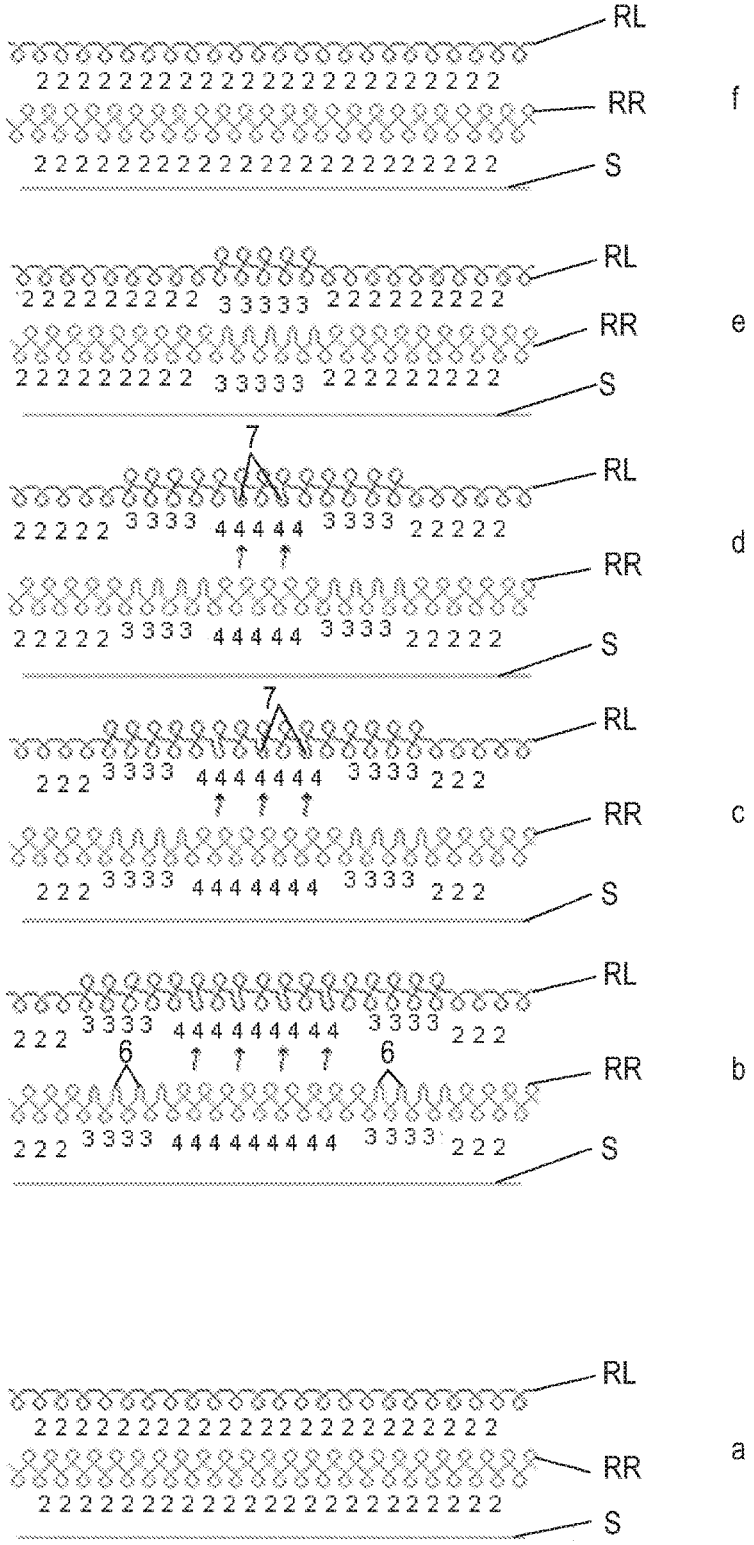
FIG. 3 is a diagram of the course of the yarn over several stitch rows for producing the first, second, and third knit fabric section using two knitted yarns and a weft yarn.

FIG. 3 shows a first example of a course of the yarn for producing the three knit fabric sections 2, 3, and 4 or the three different weaves respectively. In this embodiment, two knitted yarns and a weft yarn are used to form the knit fabric. As knitted yarn, an RR knitted yarn (right/right knitted yarn), indicated in the following figures by RR, and an RL knitted yarn (right/left knitted yarn), indicated in the following figures by RL, are used. While the RR knitted yarn is largely inelastic, the RL knitted yarn, in contrast, is significantly more elastic. The weft yarn is elastic and is indicated in the figures by S.

FIG. 3 shows as an example six stitch rows a-f, with the respective course of the yarn being shown for each stitch row. As the weft yarn S in only incorporated into the stitches, it is always shown as a simple line, while the RR and RL knitted yarns are indicated according to the yarn or stitch course.

It is also indicated in the respective stitch row, for each individual needle through which the respective RR or RL course of the yarns runs, whether the knitting is carried out in the first knit fabric section 2, the second knit fabric section 3, or the third knit fabric section 4, specifically by the corresponding numbers shown below the yarns, '2', '3', or '4'. Finally, the first knit fabric section 2 is knitted in stitch row a. It is a half-tube weave of the RR knitted yarn and the RL knitted yarn. For this purpose, the RR knitted yarn is knitted with an RR weave on both needle beds of the flat knitting machine, i.e. a right/right weave. The knitted yarn RL, which is knitted only on the front needle bed, in contrast, is knitted with an RL weave, i.e. a right/left weave. The weft yarn S is incorporated into the forming stitches.

All three knit fabric sections or all three different weaves respectively are knitted in stitch row b. In the areas indicated by '2', the RR and the RL knitted yarn are knitted in order to form the compressive half-tube base knit fabric as described above for stitch row a.

The second fabric section 3 is formed in the areas indicated by '3'. For this purpose, a tuck weave is knitted in which the RR knitted yarn is knitted by tuck stitching so that tuck stitches 6 form, as can be seen in the course of the yarn. The RL knitted yarn in this area '3' is no longer knitted with an RL weave (as in area '2'), but on both needle beds with an RR weave, i.e. a right/right weave. The above-described tuck weave, resulting from knitting of the RR yarn by tucking and knitting of the RL yarn with an RR weave, leads to increased elasticity in area '3', i.e. in the second knit fabric area 3, compared to the strongly compressive first knit fabric area 2, which has a half-tube base knit fabric weave.

The second knit fabric area is attached to the third knit fabric section 4 as shown in stitch row b. The individual needles of this area are indicated here by '4'. In this area '4', the RR yarn is again knitted with an RR weave, as can be seen from the course of the yarn. However, individual stitches, in this case every other stitch, are transferred from the front to the rear needle bed. This causes the RL yarn, which is still knitted with an RR weave, to form tuck stitches 7, specifically on the needles on which the transferred RR stitches of the RR yarn previously lay. Because of this transfer, and the fact that the RL yarn is knitted with an RR weave and is consequently knitted on the front and rear needle bed, the result is an open knit fabric that is highly elastic in the longitudinal and transverse directions which forms the 'core' of the relief zone. The transfer, i.e. the stitch transfer, is indicated in the respective stitch rows by the arrows.

Attached to the knit fabric section 4, cf. stitch row b, is the area '3', i.e. the knit fabric section 3 which forms the transition area. Here, the RR yarn is again tuck-stitched, and it forms stitches 6, while the RL yarn, again on both needle beds, is knitted with an RR weave. In the area connected thereto, indicated by '2', which forms the first knit fabric section 2, the RR yarn is again knitted with an RR weave, while the RL yarn is again knitted only on the front needle bed with an RL weave.

This pattern continues in stitch rows c and d shown in FIG. 3. Only the number or position of the stitches varies within the respective knitting areas '2', '3', '4', as can be seen by comparing stitch rows c and d with stitch row b, for example. As an example, the number of transferred RR stitches also decreases in the area '4', after which—also see FIG. 2—the third knit fabric section 4 elliptically tapers and therefore becomes increasingly narrow. However, the basic knitting pattern within the respective areas remains unchanged, which means that the respective first knit fabric section 2 is always knitted as a half-tube weave, while the second knit fabric section 3 is knitted as a tuck weave and the third knit fabric section 4 is always knitted with a stitch transfer of the RR stitches of the RR yarn and an RR-knitted RL yarn. The transferred stitches of a row are preferably staggered around a needle with respect to the transferred stitches of the previous row, resulting in a staggered 'hole pattern' in the third knit fabric area 4.

In stitch row e, only the first and the second knit fabric sections 2, 3 are knitted, as indicated by the areas '2' and '3'. Therefore in area '2', the RR yarn is knitted with an RR weave on both needle beds, and the RL yarn is knitted with an RL weave only on the front needle bed. In section '3', the RR yarn is knitted to form the tuck stitches 6 by tucking, while the RL yarn is knitted on both needle beds with an RR weave.

In the last stitch row f, corresponding to stitch row a, the base knit fabric weave is again knitted to form the knit fabric section 2.

Figure 4:
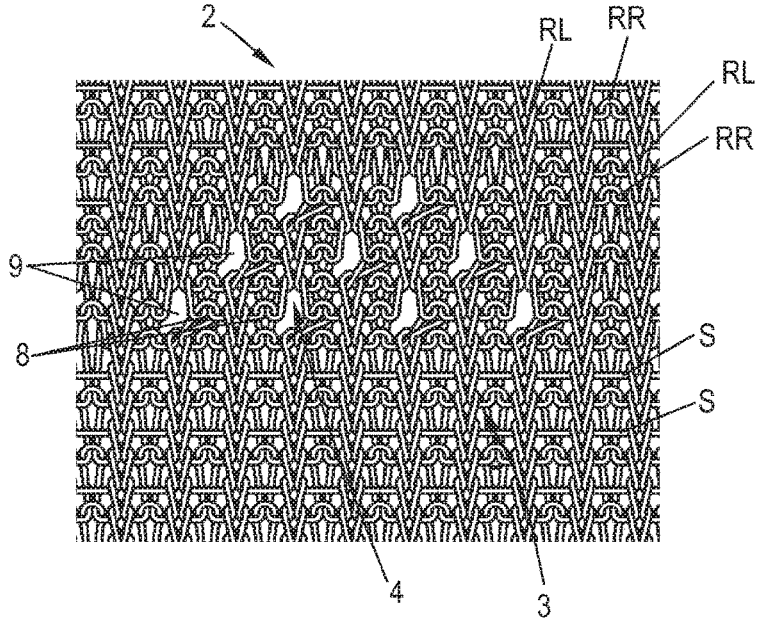
FIG. 4 is a schematic diagram of the mesh structure of the first, second, and third knit fabric section, produced according to the course of the yarn shown in FIG. 3.

FIGS. 4-7 show as an example a mesh structure or sectional views thereof respectively showing how said structure is formed with the course of the yarn according to FIG. 3. FIG. 4 shows the three knit fabric sections 2, 3, and 4. The RR yarn RR and the RL yarn RL which form the respective stitches are also shown. Only on the right edge according to FIG. 4 is the weft yarn S also shown, and it was omitted in the remainder of the figure and in FIGS. 5-7 for reasons of clarity.

Figure 5:
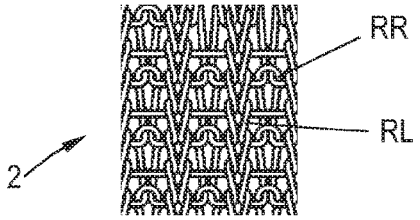
FIG. 5 is a sectional view of the mesh structure of the first knit fabric section of FIG. 4.

FIG. 5 shows an enlarged view of the mesh structure of the compressive first knit fabric section 2. As described above, the first base weave is a half-tube weave, and the RR knitted yarn is knitted on both needle beds with an RR weave. The RL knitted yarn is knitted only on the front needle bed with an RL weave, as shown in FIG. 5.

Figure 6:
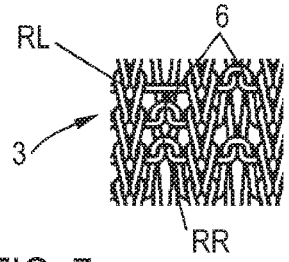
FIG. 6 is a sectional view of the mesh structure of the second knit fabric section of FIG. 4.

FIG. 6 shows an enlarged sectional view of the second knit fabric section 3. As described above, the RR knitted yarn here is tuck-knitted so that it forms the tuck stitch 6 shown in FIG. 6. For its part, the RL knitted yarn is knitted on both needle beds here with an RR weave.

Figure 7:
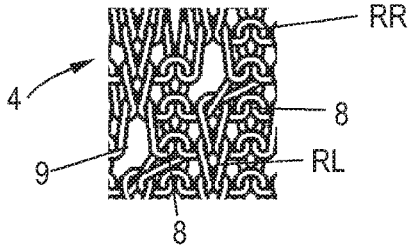
FIG. 7 is a sectional view of the mesh structure of the third knit fabric section of FIG. 4.

Finally, FIG. 7 shows a sectional view of the third knit fabric section 4. In this third weave, the RR knitted yarn is again knitted with an RR weave, but every second stitch is transferred from the front to the rear needle bed. Two examples of such transferred stitches 8 are shown in FIG. 7. They can also be clearly seen in FIG. 4.

Figure 9:
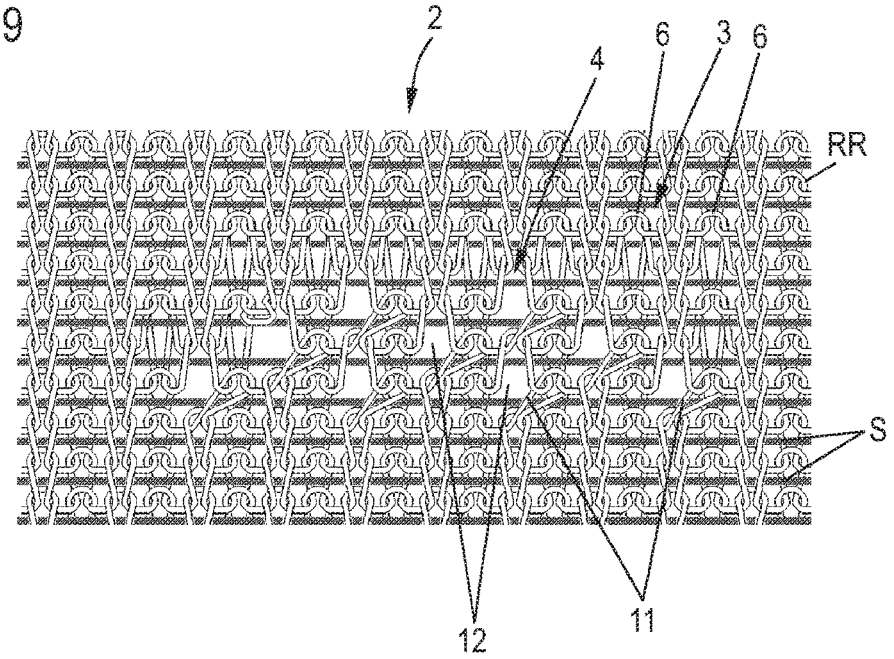
FIG. 9 is a schematic diagram of the mesh structure of the first, second, and third knit fabric section, produced according to the course of the yarn shown in FIG. 8.

The transfer of the RR stitches of the RR knitted yarn produces small 'holes' 9 in the mesh structure, as FIGS. 4 and 9 clearly show. This makes this knit fabric section 4 more open and therefore even more elastic in the longitudinal and transverse directions. The fact that the RL yarn must form tuck stitches on the empty needles resulting from the stitch transfers also contributes toward greater elasticity.

Figure 8:
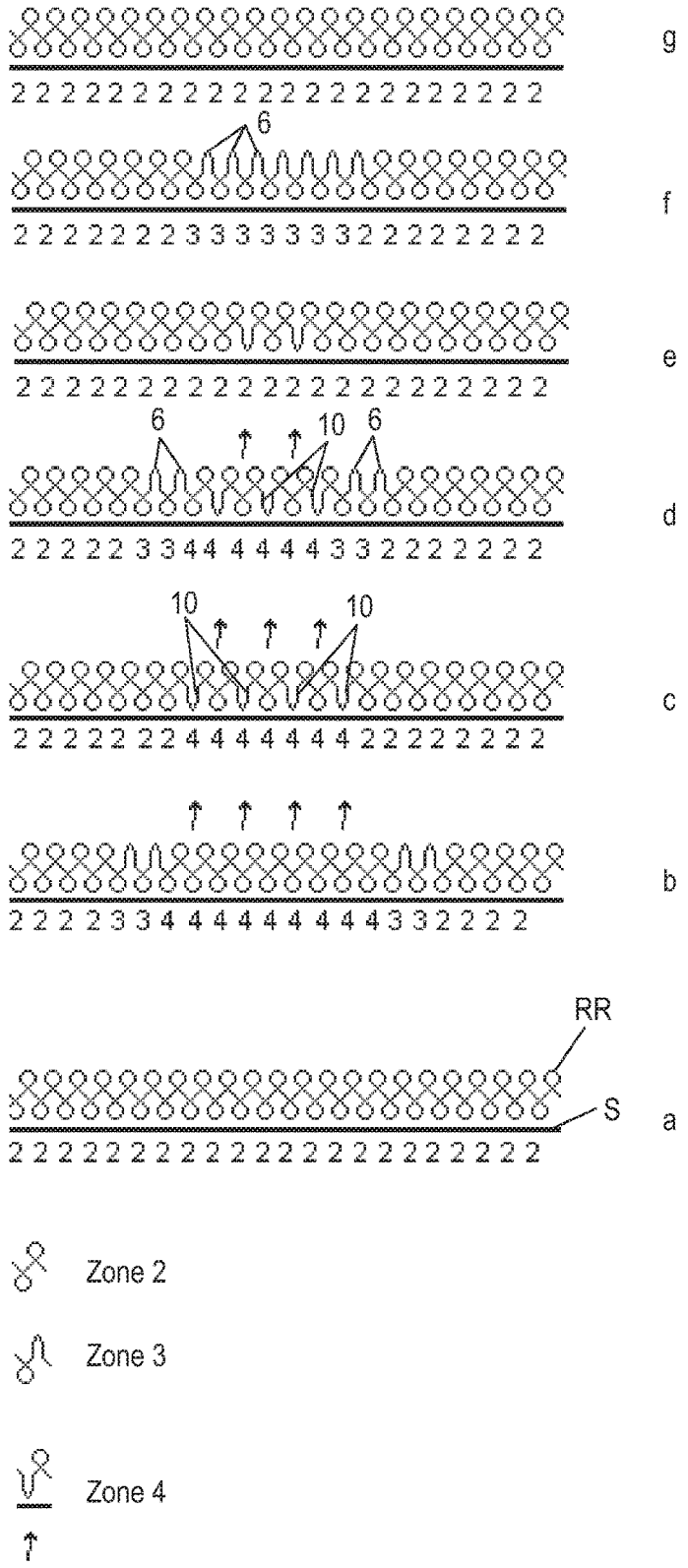
FIG. 8 is a diagram of the course of the yarn over several stitch rows for producing the first, second, and third knit fabric section using only a knitted yarn and a weft yarn.

FIG. 8 shows as an example the course of the yarn in production of all knit fabric sections 2, 3, and 4 from only one knitted yarn, specifically an RR yarn and a weft yarn S. Seven stitch rows a-g are shown here. For the individual stitch rows, the needle-specific area numbers '2', '3', and '4' are indicated, specifying the needles on which the respective knit fabric sections 2, 3, or 4 are knitted.

Loop row a is a stitch row of the first knit fabric section 2, i.e. of the base knit fabric area. The RR yarn is knitted with a pure RR weave on both needle beds. The weft yarn S is incorporated into the stitches formed.

Stitch row b shows the course of the yarn of a row of stitches in which all three fabric sections 2, 3, and 4 are knitted. In the area indicated by '2', the RR knitted yarn is again knitted with an RR weave, because it forms the first knit fabric section 2.

In the area indicated by '3', the RR knitted yarn is knitted with a tuck weave, and the corresponding tuck stitches 6 also form here. By means of these tuck stitches, greater elasticity is achieved in area '3', i.e. in the knit fabric section 3.

In area '4', the RR yarn is again knitted with an RR weave. However, every other stitch, as indicated by the arrows, is transferred from the front to the rear needle bed, and reverse transfer is also possible in this case. By means of the transfer of these stitches, i.e. the stitch transfer, the third knit fabric section 4 is provided with even greater elasticity than that of the second knit fabric section 3, which is knitted with a pure tuck weave.

In the next stitch row c, which for example is knitted on stitch row b, the RR yarn in the area '2' is still knitted with an RR weave. In area '3', the yarn is knitted with an RR weave. This is necessary in order to cast off the tuck stitches 6 of the previous stitch row b, as no two tuck stitches should be located on the same needle.

In area '4', where the RR knitted yarn is again RR knitted, tuck stitches 10 on the side of the RR yarn form on the empty needles, on which the previously transferred RR stitches lay. The transferred stitches and the tuck stitches formed, as described above, ensure the high elasticity of this third knit fabric section 4.

In stitch row d, which is knitted following stitch row c, the first knit fabric section 2 is again knitted with an RR weave. In area '3', two tuck stitches 6 are again shown, which means that this stitch row is again knitted with a tuck weave.

Corresponding stitches 10 again form in area '4', after RR stitches are again transferred from the front to the rear needle bed in the stitch row c, as indicated by the transfer arrow. The transferred stitches are staggered with respect to the transferred stitches of the previously knitted stitch row so that in the knitted mesh structure, the stitches of one row are staggered with respect to those of the other.

In stitch row e, next to the knit fabric section 2 with an RR weave, an RR weave is again knitted in knit fabric section 3, as the tuck stitches 6 of stitch row d must again be cast off.

In area '4', only two tuck stitches 10 form after two RR stitches are transferred from the front to the back in stitch row d.

In the course of the yarn according to stitch row f, only the first and second knit fabric sections 2 and 3 are knitted. This can be clearly seen from the RR weave in area '2' and the number of tuck stitches 6 in section '3'.

Finally, stitch row g) again shows a pure base knit fabric row, i.e. the knit fabric area 2 with a pure RR weave.

A mesh structure such as that resulting from the course of the yarn according to FIG. 8 is shown in FIG. 9. The RR knitted yarn and the weft yarn S respectively are shown. From the mesh structure, the individual knit fabric sections 2, 3, and 4 can again be clearly seen, said sections being shown in somewhat highlighted form in FIGS. 10, 11 and 12.

Figure 10:
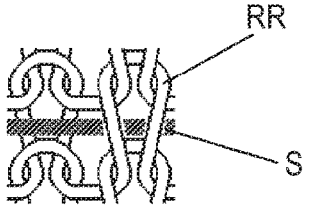
FIG. 10 is a sectional view of the mesh structure of the first knit fabric section of FIG. 9.

FIG. 10 shows a sectional view of the compressive first knit fabric section 2. The RR knitted yarn is knitted with a pure RR weave, and the weft yarn 5 runs through the stitches formed.

Figure 11:
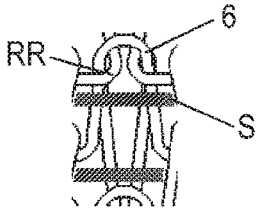
FIG. 11 is a sectional view of the mesh structure of the second knit fabric section of FIG. 9.

FIG. 11 shows a sectional view of the second knit fabric section 3. The figure shows the tuck-knitted yarn RR with a tuck stitch 6 that can also be seen in FIG. 9.

Figure 12:
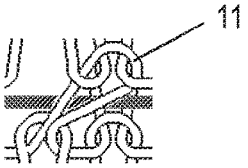
FIG. 12 is a sectional view of the mesh structure of the third knit fabric section of FIG. 9.

Finally, FIG. 12 shows a sectional view of the third knit fabric section 4 with a transferred RR stitch 11 which can also be clearly seen in FIG. 9. As every second RR stitch 11 is transferred, this produces in each stitch row holes 12 which are positioned at intervals from one another in a mutually staggered pattern from one stitch row to the next, and as clearly shown in FIG. 9, these holes impart to the third knit fabric section 4 a certain openness and thus even greater elasticity.

Both of the variants shown in the FIGS. 3-7 and 8-12 respectively make it possible to produce the three knit fabric sections 2, 3, and 4 with different weaves and different transverse and longitudinal elasticities. In this manner, in the third knit fabric section 4, which is configured to be as elastic as possible, a pressure relief zone that can be configured in any desired size is produced, said zone being connected softly and with a constant pressure transition profile via the second knit fabric section 2, which has a somewhat lower elasticity, to the first, strong compression knit fabric section 2. The knit fabric sections 3 and 4 can have any final shape desired, they may be round, elliptical, square, or rectangular, or have any other shape, and this ultimately depends on the geometry of the pressure relief area.

The use of two knitted yarns, preferably of the above-described RR and RL knitted yarns, makes it possible to achieve significantly higher elasticity gradients, and therefore pressure gradients, between the first knit fabric section 2, the second knit fabric section 3, and the third knit fabric section 4. The use of only one knitted yarn, in the example a RR knitted yarn, also allows the configuration of an elasticity or pressure gradient, but not entirely to the extent allowed by the use of two knitted yarns. The use of two knitted yarns also provides a more optically attractive mesh structure than the use of only one knitted yarn. At the same time, however, the object of the invention is also achieved using only one knitted yarn.

In forming the individual knit fabric sections, it is possible to use knitted yarns of the same or different colors. This would make it possible to optically emphasize the relief area, i.e. the knit fabric sections 3 and 4, by knitting it in a different color.

While specific embodiments of the invention have been shown and described in detail to illustrate the inventive principles, it will be understood that the invention may be embodied otherwise without departing from such principles.

We claim:

1. A compression knit fabric, in particular a flat-knit fabric, composed of at least one knitted yarn and an incorporated elastic weft yarn, with a first knit fabric section having a compressive first base mesh structure, to which, within separate stitch rows of the first knit fabric section between two areas of the first knit fabric section, is knitted a second knit fabric section having a second mesh structure different from the base mesh structure which imparts to the second knit fabric section greater elasticity in a longitudinal or a transverse direction of the knit fabric section than in the first knit fabric section, to which is knitted a third knit fabric section having a third mesh structure different from the first base mesh structure and second base mesh structure which imparts to the third knit fabric section greater elasticity in the longitudinal or the transverse direction of the knit fabric section than in the second knit fabric section.

2. The knit fabric component according to claim 1, wherein all of the knit fabric sections are knitted with a right-right (RR) knitted yarn, a right-left (RL) knitted yarn that is more elastic, and the weft yarn.

3. The knit fabric component according to claim 2, wherein the first base weave is a half-tube weave of the RR knitted yarn, which is knitted with an RR weave, the RL knitted yarn, which is knitted with an RL weave, and the incorporated weft yarn.

4. The knit fabric component according to claim 3, wherein in the second weave, the RR knitted yarn is a tuck stitch and the RL knitted yarn is knitted with an RR weave, or the RL knitted yarn is a tuck stitch and the RR knitted yarn is knitted with an RL weave.

5. The knit fabric component according to claim 3, wherein in the third weave, the RR knitted yarn is knitted with an RR weave and the RL knitted yarn is knitted with an RR weave, with at least a part of the stitches knitted with the RR knitted yarn being transferred.

6. The knit fabric component according to claim 5, wherein every second, third, or fourth stitch knitted with the RR knitted yarn is transferred.

7. The knit fabric component according to claim 5, wherein the transferred stitches of a stitch row knitted with the RR knitted yarn are staggered with respect to the transferred stitches of the stitch row previously knitted with the RR knitted yarn.

8. The knit fabric component according to claim 1, wherein all of the knit fabric sections are knitted with an RR knitted yarn and the weft yarn.

9. The knit fabric component according to claim 8, wherein the first base weave comprises an RR weave knitted with the RR knitted yarn and the incorporated weft yarn.

10. The knit fabric component according to claim 9, wherein in the second weave, the RR knitted yarn is tuck-knitted.

11. The knit fabric component according to claim 9, wherein in the third weave, the RR knitted yarn is knitted with an RR weave, with at least some of the stitches knitted with the RR knitted yarn being transferred.

12. The knit fabric component according to claim 11, wherein every second, third, or fourth stitch knitted with the RR knitted yarn is transferred.

13. The knit fabric component according to claim 11, wherein the transferred stitches of a stitch row knitted with the RR knitted yarn are staggered with respect to the transferred stitches of the stitch row previously knitted with the RR knitted yarn.

14. The knit fabric component according to claim 1, wherein the first knit fabric section partially or completely surrounds the second knit fabric section or the second knit fabric section partially or completely surrounds the third knit fabric section.

15. The knit fabric component according to claim 1, comprising being a stocking, a sock, a leg stocking, an arm stocking, a body stocking, or a bandage.

16. The knit fabric component according to claim 15 configured as a stocking or sock, wherein a fourth knit fabric section is provided, to which is connected at least the first knit fabric section.

17. The knit fabric component according to claim 16, wherein all three knit fabric sections are attached to the fourth knit fabric section.

18. A method for producing a knit fabric component using a flat knitting machine having a front and a rear needle bed, in which a first knit fabric section having a compressive first base mesh structure is knitted, to which, within separate stitch rows of the first knit fabric section between two areas of the first knit fabric section, is knitted a second knit fabric section having a second mesh structure different from the base mesh structure which imparts to the second knit fabric section greater elasticity in a longitudinal or a transverse direction of the knit fabric section than in the first knit fabric section, to which is knitted a third knit fabric section having a third mesh structure different from the first base mesh structure and second base mesh structure which imparts to the third knit fabric section greater elasticity in the longitudinal or the transverse direction of the knit fabric section than in the second knit fabric section.

19. The method according to claim 18, wherein all of the knit fabric sections are knitted with a right-right (RR) knitted yarn, a right-left (RL) knitted yarn, and the weft yarn.

20. The method according to claim 19, wherein a first base weave is composed of a half-tube weave from an RR knitted yarn which is knitted with an RR weave, an RL knitted yarn which is knitted in an RL weave, and the incorporated weft yarn.

21. The method according to claim 20, wherein in the second weave, the RR knitted yarn is tuck-knitted and the RL knitted yarn is knitted with an RR weave, or the RL knitted yarn is tuck-knitted and the RR knitted yarn is knitted with an RL weave.

22. The method according to claim 20, wherein in the third weave, the RR knitted yarn is knitted with an RR weave, and the RL knitted yarn is knitted with an RR weave, with at least some of the stitches knitted with the RR knitted yarn being transferred from one needle bed to the other.

23. The method according to claim 22, wherein every second, third, or fourth stitch knitted with the RR knitted yarn is transferred.

24. The method according to claim 23, wherein the transferred stitches of a stitch row knitted with the RR knitted yarn are staggered with respect to the transferred stitches of the stitch row previously knitted with the RR knitted yarn.

25. The method according to claim 18, wherein all of the knit fabric sections are knitted with an RR knitted yarn and the weft yarn.

26. The method according to claim 25, wherein the first base weave is knitted using RR weave knitted from the RR knitted yarn and the incorporated weft yarn.

27. The method according to claim 26, wherein in the second weave, the RR knitted yarn is knitted by tuck stitching.

28. The method according to claim 26, wherein in the third weave, the RR knitted yarn is knitted with an RR weave, with at least a part of the stitches knitted with the RR knitted yarn being transferred.

29. The method according to claim 28, wherein every second, third, or fourth stitch knitted with the RR knitted yarn is transferred.

30. The method according to claim 28, wherein the transferred stitches of a stitch row knitted with the RR knitted yarn are staggered with respect to the transferred stitches of the stitch row previously knitted with the RR knitted yarn.

31. The method according to claim 18, wherein the first knit fabric section is knitted so as to partially or completely surround the second knit fabric section or the second knit fabric section is knitted so as to partially or completely surround the third knit fabric section.

32. The method according to claim 18, wherein the knit fabric component is a stocking, a sock, a leg stocking, an arm stocking, a body stocking, or a bandage.

33. The method according to claim 32, wherein a fourth knit fabric section is attached at least to the first knit fabric section.

34. The method according to claim 33, wherein all three knit fabric sections are attached to the fourth knit fabric section, wherein the first knit fabric section only partially surrounds the second knit fabric section and the second knit fabric section only partially surrounds the third knit fabric section.

* * * * *